US006283249B1

(12) United States Patent
Young et al.

(10) Patent No.: US 6,283,249 B1
(45) Date of Patent: Sep. 4, 2001

(54) MOBILE LADDER WITH LIFTING TRAY

(75) Inventors: David T. Young, Oconomowoc; Scott E. Kaczor, Greenfield, both of WI (US)

(73) Assignee: EGA Products, Inc., Brookfield, WI (US)

( * ) Notice: Subject to any disclaimer, the term of this patent is extended or adjusted under 35 U.S.C. 154(b) by 0 days.

(21) Appl. No.: 09/547,839

(22) Filed: Apr. 12, 2000

(51) Int. Cl.[7] ..... E04G 3/16; B66B 11/08
(52) U.S. Cl. ..... 182/17; 182/12; 187/255
(58) Field of Search ..... 182/12, 13, 14, 182/15, 16, 17, 115, 141, 103; 187/255, 270

(56) References Cited

U.S. PATENT DOCUMENTS 2,762,659 * 9/1956 Harlan et al. ..... 182/17 X
3,176,794 * 4/1965 Evans et al. ..... 182/17
3,232,377 * 2/1966 Smith ..... 182/115
4,664,230 * 5/1987 Olsen ..... 182/255 X

* cited by examiner

*Primary Examiner*—Daniel P. Stodola
*Assistant Examiner*—Hugh B. Thompson
(74) *Attorney, Agent, or Firm*—Andrus, Sceales, Starke & Sawall, LLP

(57) ABSTRACT

A combined stepped structure and lifting mechanism includes a base and a framework secured to the base, the framework having a pair of spaced apart vertical tubes rising upwardly from the base. A ladder is incorporated in the framework and a vertical track assembly is disposed between the vertical tubes and includes a pair of tubular members connected together. A trolley is rollably mounted for movement along one of the tubular members. A lifting tray assembly is connected for movement with the trolley. A drive system is operably connected to the trolley and driven by a DC motor and gearbox unit mounted to a bottom end of the vertical track assembly to selectively move the lifting tray assembly upwardly and downwardly along the vertical track assembly.

23 Claims, 8 Drawing Sheets

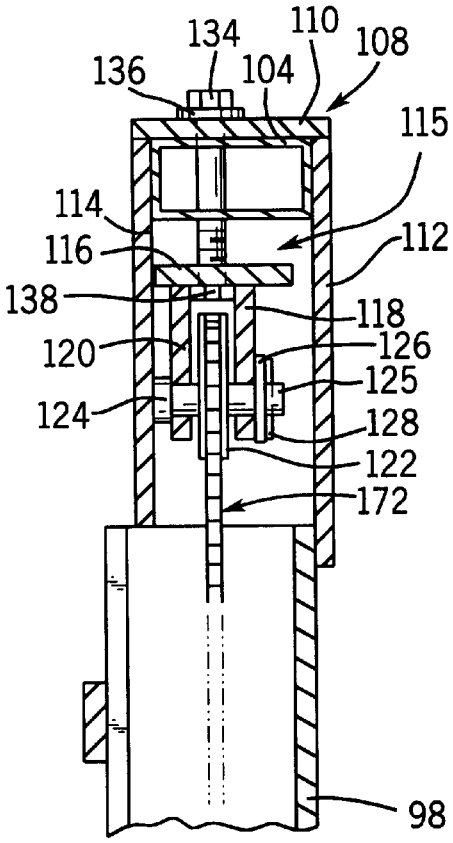
FIG. 4
FIG. 2
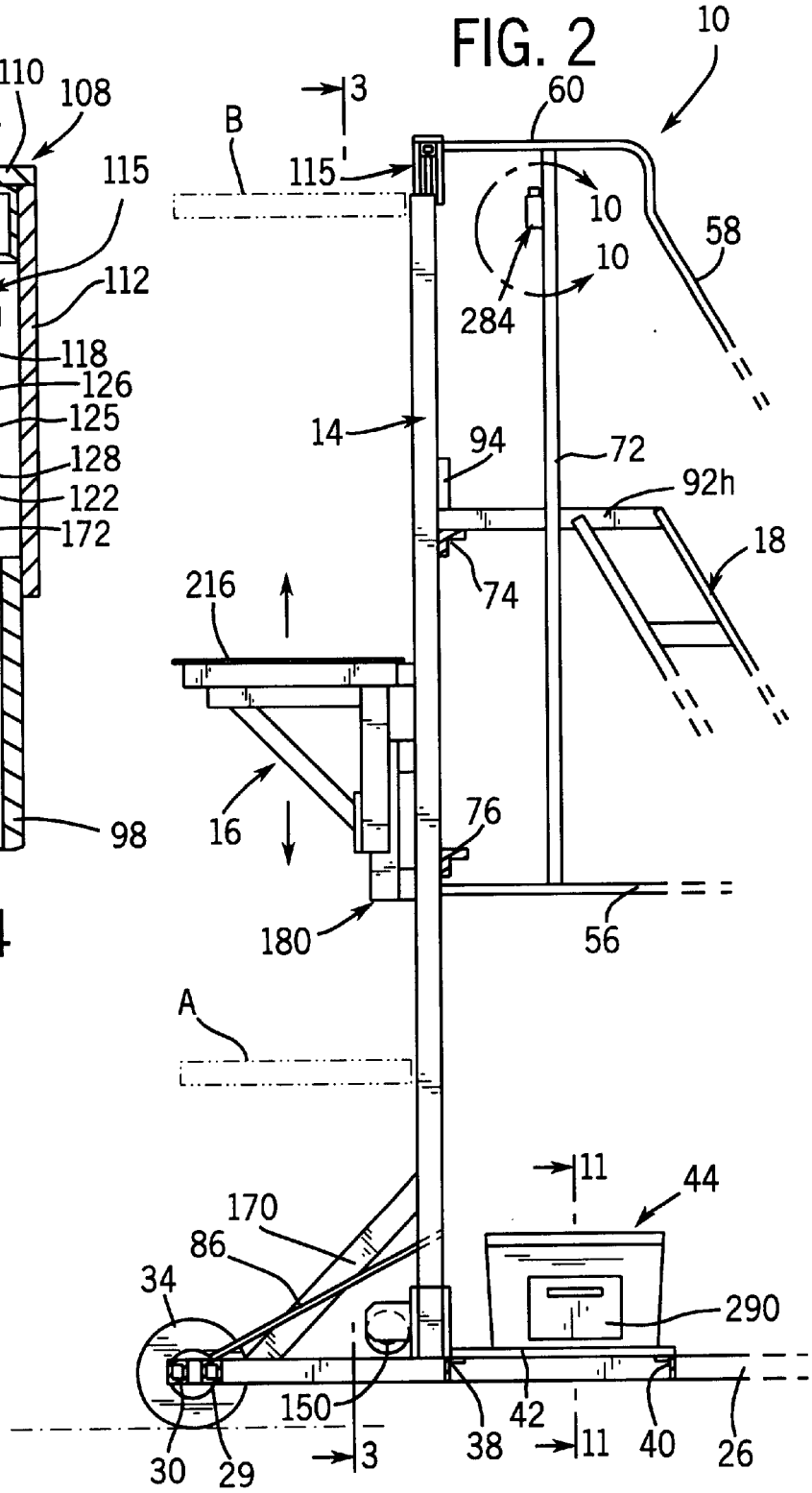

FIG. 5
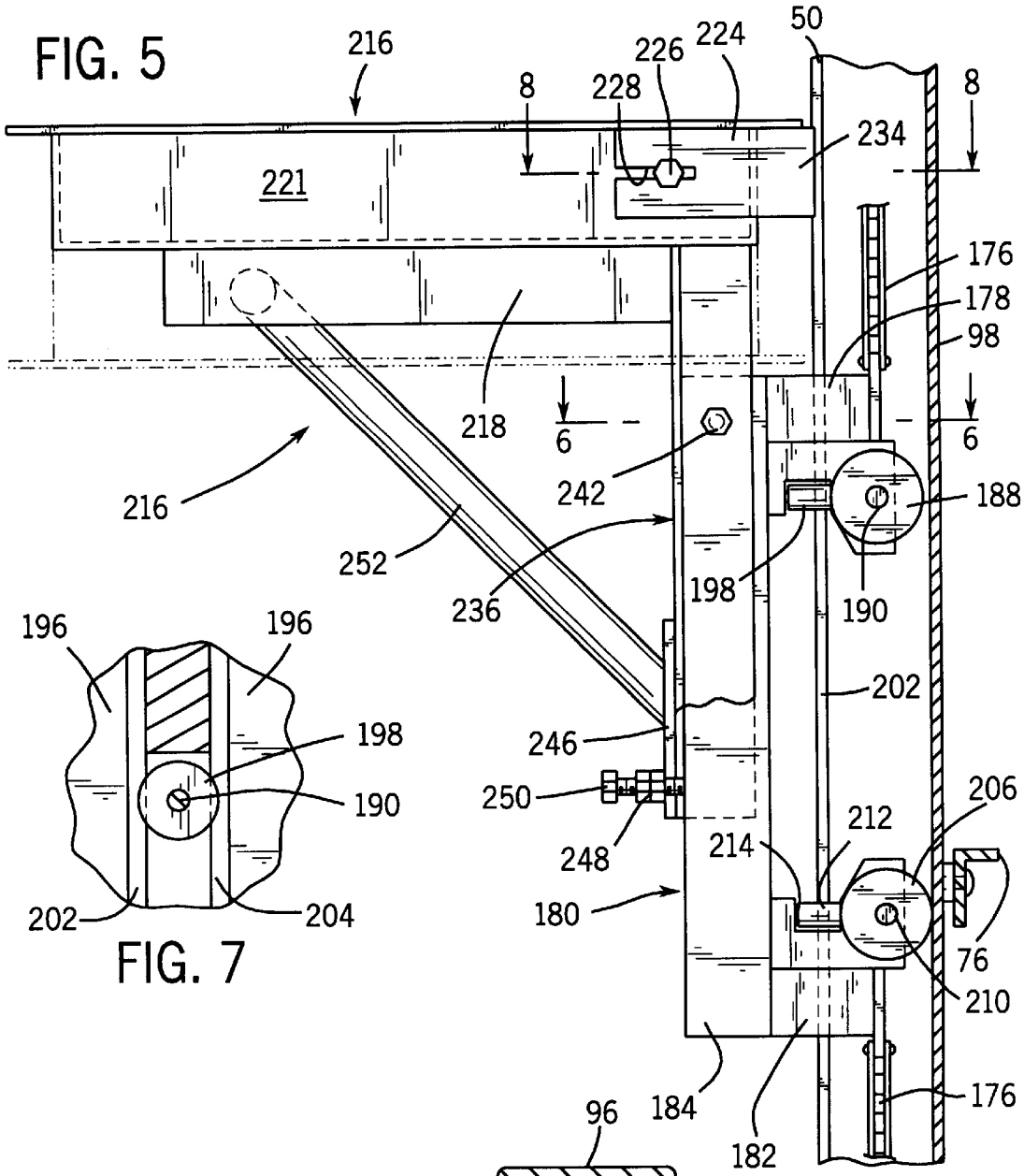
FIG. 7
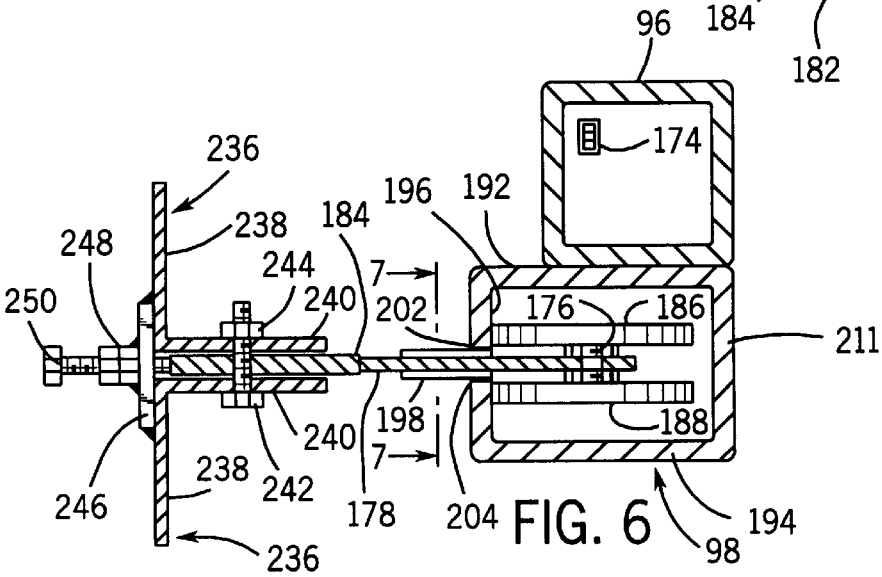
FIG. 6

FIG. 8
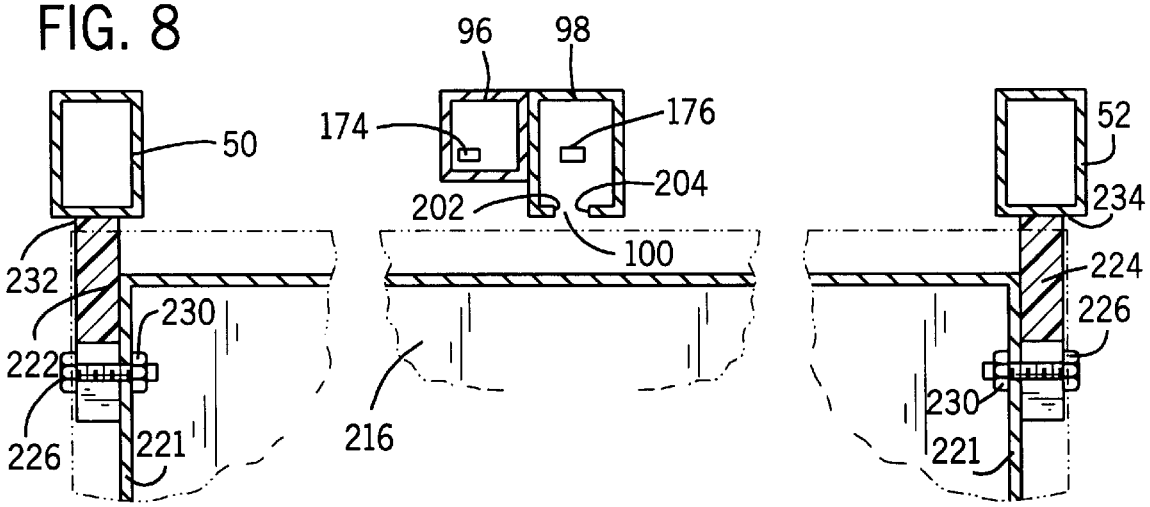
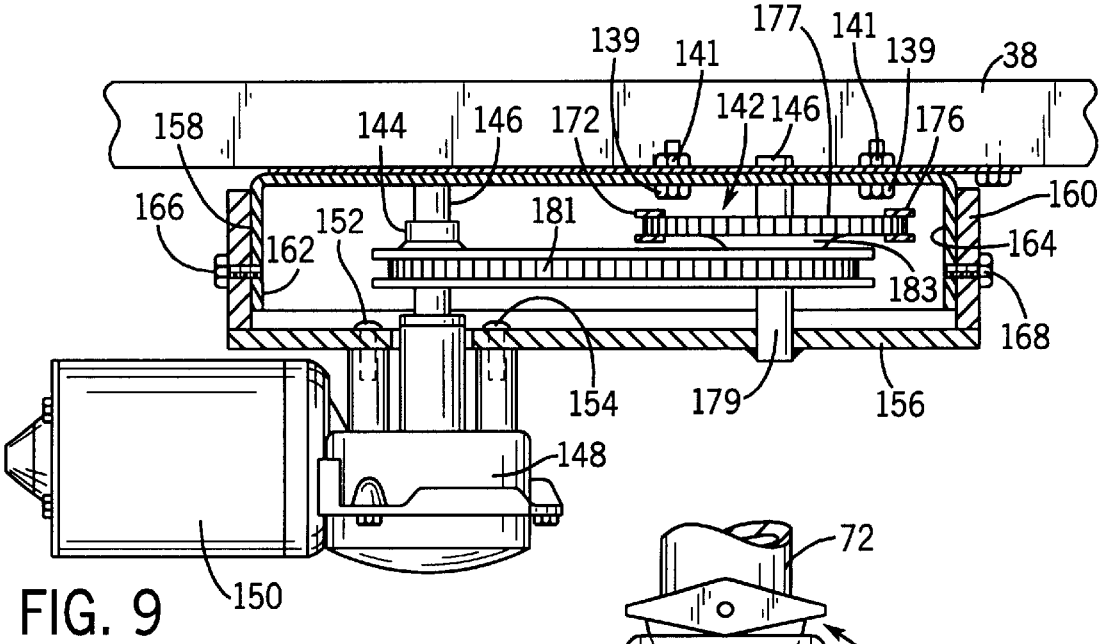
FIG. 9
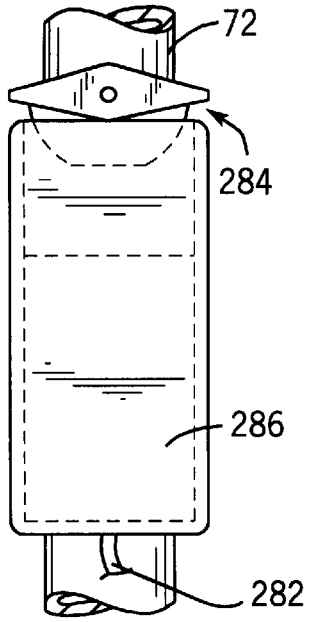
FIG. 10

MOBILE LADDER WITH LIFTING TRAY

FIELD OF THE INVENTION

This invention relates broadly to material handling, and more particularly, to a stepped structure, such as a mobile ladder, equipped with a lifting mechanism for raising and lowering materials along a vertical axis.

BACKGROUND OF THE INVENTION

Warehouse workers or the like regularly employ stepped structures such as mobile ladders, scaffolds and platforms to reach a particular work location. In the course of completing their tasks, it is common practice for a worker to carry various tools, supplies, accessories and other articles while climbing the stepped structure. For example, a retail worker may scale a ladder using one or both hands to transport inventory to a desired elevation. Such practice not only jeopardizes the safety of the worker, but may require multiple trips up and down the ladder which contributes to the inefficiency of the task.

In an effort to remedy these problems, the assignee of the present invention has previously produced a mobile ladder that is provided with a motorized lifting mechanism for selectively assisting the worker in raising and lifting a loaded tray thereby enabling the worker to use both hands to grasp handrails while climbing. This prior art design (See FIG. 13) includes a metal lifting tray that is slidably mounted upon a track assembly and connected to a cable which is engaged about a pulley at the top of the track assembly. The cable extends downwardly along the front side of the track assembly and is wound around a lower pulley fixed on a mounting plate on a movable base of the ladder. The free end of the cable is attached to a winch, which has a motor driven by a battery. Both the winch and battery are secured on the mounting plate.

While this combined ladder and lifting mechanism has generally been useful, it has been found that the winch motor is extremely noisy and also creates an unreasonable amount of vibration which is conducted to the surrounding framework. In addition, the cable between the lifting tray and the winch is susceptible to premature wear, thus limiting the maximum loads for the lifting mechanism. The engagement of the cable on the pulleys further adds to the noise problem of the winch. Another problem resides in the particular mounting of the lifting tray upon the track assembly which has occasionally led to binding and jamming during raising and lowering of the loaded tray. Also, the unprotected nature of the winch motor and the battery on the mounting plate exposes these elements to moisture, temperature and other environmental conditions which can affect their maintenance, operability and reliability.

For the above reason, the prior art design has not proved entirely effective and convenient to use. Accordingly, it has been found desirable to provide an improved ladder with a lifting tray that offers the following advantages over the prior art systems including a smoother and quieter lifting operation; a more efficient, reliable and better controlled drive system for the lifting tray; and, retrofit capability. Such a ladder and lifting tray should be easy to assemble and maintain, and more economical to produce.

SUMMARY OF THE INVENTION

The present invention advantageously resides in an enhanced, combination ladder and lifting mechanism having widespread utility for vertically moving articles between different heights. In particular, the invention uses a chain drive to overcome the problems associated with the prior art cable/winch system.

In accordance with one aspect of the invention, a combined stepped structure and lifting mechanism includes a base and a framework secured to the base.

The framework has a pair of spaced apart vertical tubes rising upwardly from the base. A ladder is incorporated in the framework. A vertical track assembly is disposed between the vertical tubes and includes a pair of tubular members connected together.

A trolley is rollably mounted for movement along one of the tubular members. A lifting tray assembly is connected for movement with the trolley. A drive system is operably connected to the trolley and driven by a DC motor and gearbox unit which are mounted to a bottom end of the vertical track assembly. The drive system selectively moves the lifting tray assembly upwardly and downwardly along the vertical track assembly. The tubular members of the vertical track assembly include a square tube and a box channel having a front wall and a rear wall provided with a slot running along the length of the rear wall. The trolley has an elongated vertical plate with an upper guide structure projecting through the slot and upper guide wheels engageable with the box channel rear wall, and lower guide structure projecting through the slot and including lower guide wheels engageable with the box channel front wall. The upper guide structure further includes an upper guide roller engageable with the surfaces forming the slot, and a lower guide structure further includes a lower guide roller engageable with the surfaces forming the slot. The upper and lower guide rollers are mounted on axes of rotation which are substantially perpendicular to the axes of rotation of the upper and lower guide wheels. This configuration helps to stabilize the lifting tray connected to the trolley. The top of the vertical track assembly includes an idler sprocket mounted for rotation, and the bottom of the vertical track assembly includes a drive sprocket mounted upon a driven shaft extending from the DC motor and gearbox. The drive system includes a first run of drive chain entrained about the idler sprocket, running entirely through the square tube and wrapping around the drive sprocket, and a second run of drive chain running partially through the box channel and being connected to the upper guide structure and the lower guide structure. The lifting tray assembly includes a generally rectangular tray having sides provided at forward ends with guide blocks constructed of low friction material slidably engageable with the framework vertical tubes. The lifting tray further includes a pair of spaced apart, right angled, tray mounting brackets depending from the forward end of the tray. Each tray mounting bracket has a laterally extending portion and a forwardly extending portion.

The vertical plate of the trolley is interposed between the forward extending portions of the tray mounting brackets and fixed thereto. The lifting tray also includes a face plate attached to the laterally extending portions of the tray mounting brackets and provided with a nut adapted to receive an adjusting screw which passes through the face plate and between the tray mounting brackets. An end of the adjusting screw is engageable with the vertical plate to adjust the level of the tray. The drive system includes a chain enclosed by the vertical track assembly and connected with the trolley, the chain being driven by the DC motor and gearbox unit. An adjustment assembly is mounted on the vertical track assembly for tensioning the chain.

In accordance with another aspect of the invention, the combined stepped structure and lifting mechanism has a movable base, a framework rising from the base, a ladder incorporated in the framework, a vertical track assembly secured to the framework and a lifting tray assembly mounted for movement along the vertical track assembly. A drive system is mounted adjacent the base for selectively moving the lifting tray assembly along the vertical track assembly. Preferably the vertical track assembly is formed by a tubular structure extending between top and bottom portions of the framework. The drive system includes a drive chain passing through the interior of the tubular structure and entrained about an idler sprocket rotatably mounted at the top of the vertical track assembly and a drive sprocket mounted on a driven shaft of an electromagnetic DC motor and gearbox unit secured to a bottom end of the framework. The tubular structure is defined by a pair of elongated tubular members connected together in side-by-side relationship. The vertical track assembly preferably includes a mechanism for adjusting the tension of the drive chain. A protective guard is preferably connected between the base and the framework over the DC motor and gearbox unit.

In accordance with yet another aspect of the invention, a combined stepped structure and lifting mechanism has: a movable base; a framework rising from the base; a ladder incorporated in the framework; a vertical track assembly secured to the framework; a lifting tray assembly mounted for movement along the vertical track assembly; a drive system includes a DC motor mounted adjacent the base for selectively moving the lifting tray assembly along the vertical track assembly; and a protective enclosure mounted on the base that houses a battery arrangement connected to the DC motor for energization thereof. The protective enclosure has a lower structure and a top structure hingedly attached thereto. The lower structure carries a battery recharger adapted to be connected with a source of AC power. The top structure is provided with a mercury switch on an inside surface thereof, whereby the recharger is operational only when the top structure is pivoted away from the lower structure to prevent the buildup of gases within the enclosure. The protective enclosure is disposed between the ladder and a vertical track assembly, preferably on the base of the ladder. The lower structure of the protective enclosure includes a pair of relays for controlling power to the DC motor. The DC motor is selectively controlled by a toggle switch operably connected to the battery arrangement and mounted on an upper portion of the framework. And yet another aspect, the invention resides in a retrofit kit for retrofitting existing mobile ladders with a chain driven lifting tray assembly. The retrofit kit preferably includes the vertical track assembly a drive chain entrained around an idler sprocket mounted for rotation at the top of the vertical track assembly and a drive sprocket mounted at the bottom of the vertical track assembly, a DC motor and gearbox unit providing power to the drive shaft, and at least one battery provider within a protective enclosure as well as other electrical equipment. Preferably, the track assembly for the retrofit unit includes an upper cross tube with brackets at either end to facilitate ease of installation on existing ladders in the field.

From the foregoing, it should be apparent that the invention accomplishes the following objectives. It is one object of the present invention to incorporate the lifting tray mechanism into a movable ladder in order to selectively elevate and lower various tools, supplies and material.

It is another object of the present invention to provide a combined ladder and lifting mechanism having a unique track assembly, lifting tray assembly and direct drive system which are capable of being retrofit on an existing ladder structure.

It is also an object of the present invention to provide a mobile ladder and lifting system having a trolley with wheel and roller structure for smoothly moving a lifting tray along a vertical track assembly attached to the ladder.

It is a further object of the present invention to provide a ladder and lifting structure with a gearbox and DC motor for moving a chain drive connected to a lifting tray.

It is still another object of the present invention to provide a ladder and lifting mechanism having a portable, conditionally rechargeable power supply which is protected from the environment.

It is yet another object of the present invention to provide an integral ladder and lifting device having a selective control conveniently located on the surrounding ladder framework.

Yet another object of the present invention is to provide adjustment structure for positioning a lifting tray movable on a ladder and for tensioning a chain used to move the lifting tray.

Various other features, objects and advantages of the invention will be made apparent from the following description taken together with the drawings.

BRIEF DESCRIPTION OF THE DRAWINGS

FIG. 2 is a fragmentary side view of the ladder in FIG. 1 with certain portions removed for clarity;

FIG. 4 is a partial cross sectional view taken on line 4—4 of FIG. 3;

FIG. 5 is a partial cross sectional view taken on line 5—5 of FIG. 3;

FIG. 6 is a cross sectional view taken on line 6—6 of FIG. 5;

FIG. 7 is an enlarged, detailed view taken on line 7—7 of FIG. 6;

FIG. 8 is a partial cross sectional view taken on line 8—8 of FIG. 5;

FIG. 9 is a partial cross sectional view taken on line 9—9 of FIG. 3;

FIG. 10 is a detailed view taken on line 10—10 of FIG. 2;

DETAILED DESCRIPTION OF THE INVENTION

Figure 1:
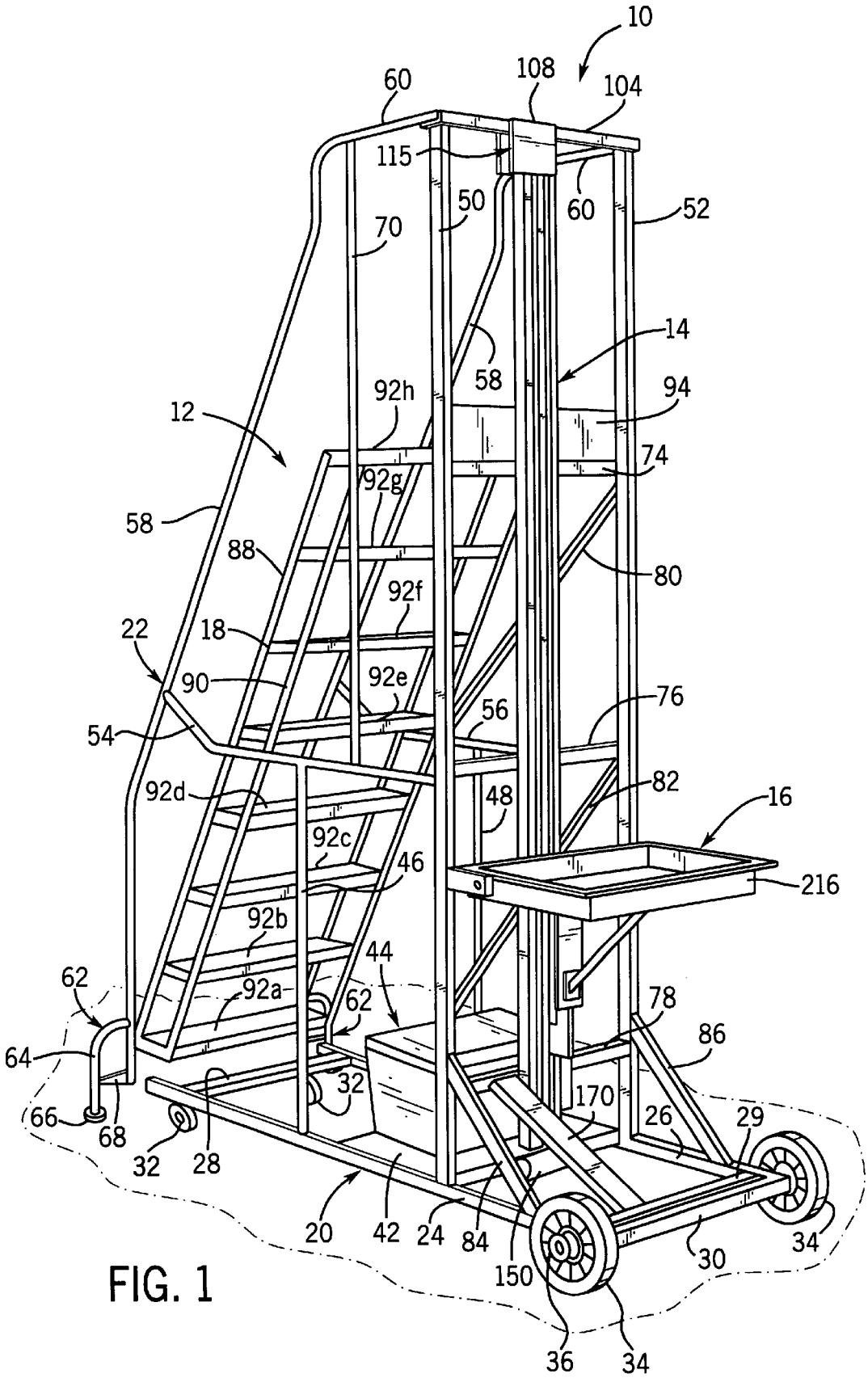
FIG. 1 is a perspective view of a mobile ladder with a lifting tray embodying the invention.

Referring now to FIGS. 1 and 2, where the invention is generally identified by reference numeral 10, it can be seen that the invention basically includes a movable stepped structure 12 provided with a vertical track assembly 14 and a lifting tray assembly 16 for raising and lowering equipment, tools and supplies along a vertical axis. In the preferred embodiment, the stepped structure 12 is preferably shown as a ladder 18, but it should be understood that the stepped structure 12 may also take the form of a staircase, platform, scaffold, or the like used in climbing from a lower level to a higher level. In the description to follow, the stepped structure 12 is typically fabricated from rigid metal components which are fastened together by welding unless otherwise noted.

Stepped structure 12 is comprised of a generally rectangular base 20 and a substantially upright framework 22 that supports the track assembly 14, lifting tray assembly 16, ladder 18 and various electrical and drive components used in connection therewith. Base 20 includes a pair of parallel, horizontal side rails 24,26 joined together by a front cross mount 28 and a pair of parallel, rear cross mounts 29,30, respectively. A set of swiveled casters 32 is provided at the front ends of the side rails 24,26. A pair of non-swiveled, rubber-coated wheels 34 is mounted for rotation at the opposite ends of an axle 36 which is positioned at the rear of the base 20 between the rear cross mounts 29,30. Two intermediate cross members 38,40 (FIG. 2) transversely span the side rails 24,26 and provide support for a generally rectangular mounting plate 42 upon which a covered electrical enclosure 44 to be further described hereafter is fixed.

Framework 22 is constructed with a pair of parallel, lower vertical members 46,48 which rise upwardly from the side rails 24,26 of the base 20 forwardly of enclosure 44. In addition, a pair of vertical tubes 50,52 which define the overall height of framework 22 extend upwardly from the side rails 24,26 rearwardly of enclosure 44. The top ends of vertical members 46,48 are fixed to a pair of parallel, horizontal braces 54,56, each of which has a rearward end connected to a respective vertical tube 50,52. Each horizontal brace 54,56 also has a forward end connected to an upwardly and rearwardly extending handrail 58 having an upper horizontal section 60 and a lower outrigger section 62. The ends of the horizontal sections 60 of the hand rails 58 are connected to the upper ends of the vertical tubes 50,52. The outrigger sections 62 each include a curved leg 64 terminating in a resilient bumper 66 and a reinforcing link 68 joined between the curved leg 64 and the bottom end of the handrail 58. A pair of upper vertical members 70,72 (FIG. 2) extend between the horizontal braces 54,56 and the handrail upper horizontal sections 60. A set of three horizontal crossbars 74,76,78 and a pair of diagonal sway braces 80,82 extend between the vertical tubes 50,52 to add strength to the rear portion of framework 22. In addition, a pair of parallel, reinforcing back braces 84,86 extend at an angle between the lower portions of the vertical tubes 50,52 and the rear sections of the side rails 24,26.

Ladder 18 has a pair of front and rear stringers 88,90, respectively, on each side that is interconnected and held in parallel alignment by a series of steps 92*a–h*, each of which is usually provided with a non-skid surface. The uppermost step or platform 92*h* includes an upwardly projecting toe plate 94 and is secured at its back end to the cross bar 74. The lowermost step 92*a* is fixed to the lower portions of the handrails 58. The stringers 88,90 are also connected to the horizontal braces 54,56 to lend further support. In the preferred embodiment, the ladder 18 is oriented at about 60° relative to the floor or ground surface, there being a ten inch rise between each step. The ladder 18 is incorporated into the framework 22 and base 20 in combination so that it may be easily moved from one location to the next. Although not shown, the bottommost step 92*a* is provided with a commercially available locking mechanism which will prevent rolling movement of the casters 32 when the movable ladder is located at the desired location. This mechanism will also cause the bumpers 66 on outrigger legs 64 to firmly engage the floor or ground surface when one's foot is placed on the bottommost step 92*a*.

Figure 3:
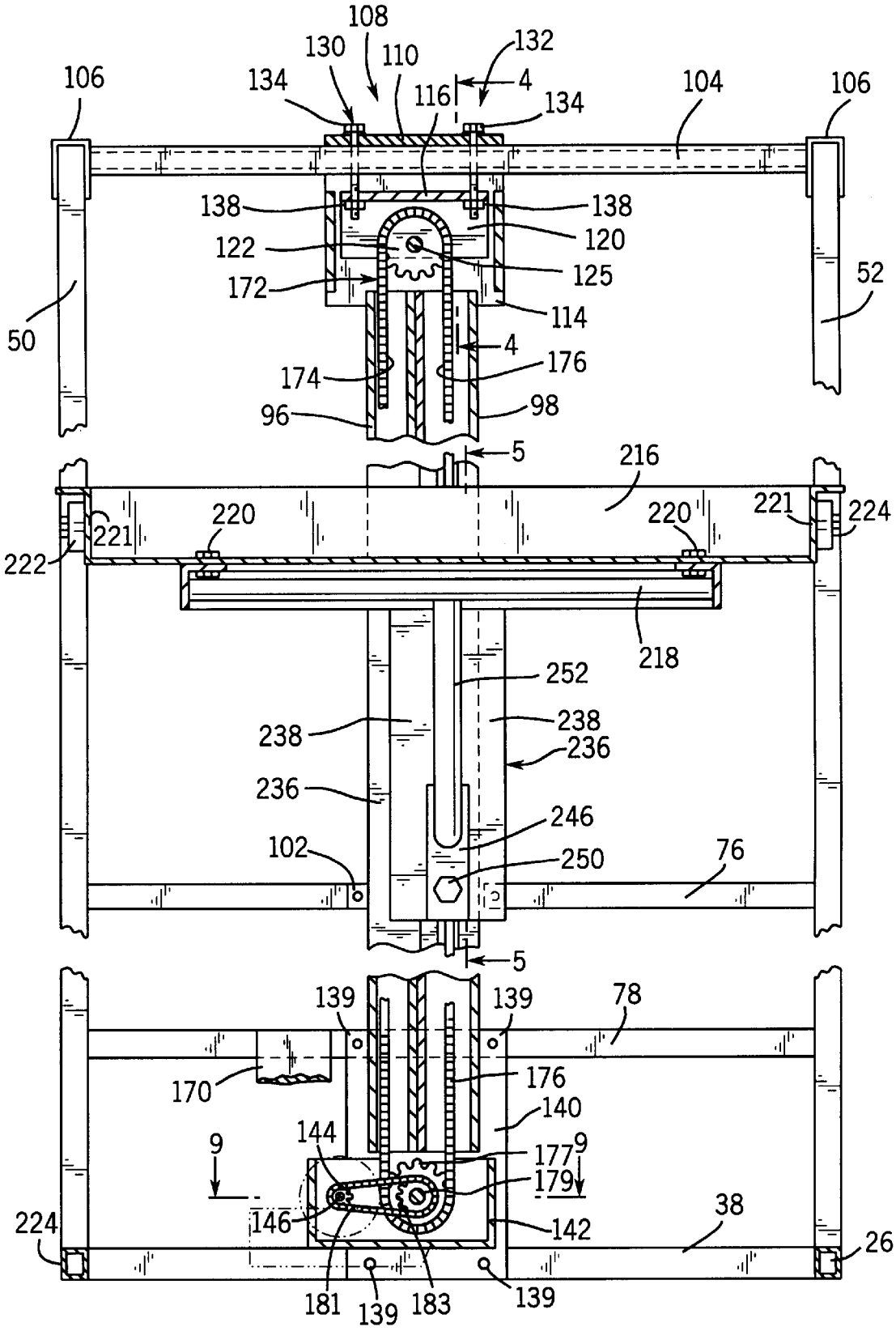
FIG. 3 is a fragmentary view taken on line 3—3 of FIG. 2 with certain portions broken away and/or shown in cross section.

In accordance with the invention, the track assembly 14 is disposed between the vertical tubes 50,52 and runs substantially coextensively along the length thereof. As best seen in FIGS. 3, 4 and 8, the track assembly 14 includes a square tube 96 joined in side-by-side relationship to a box channel 98 having a slot 100 opening from the rear thereof. The joined tube 96 and box channel 98 are removably connected to the framework crossbars 74,76 and 78, such as by rectangular track mounts, one of which is shown at 102 in FIG. 3. The track assembly 14 further includes an upper cross tube 104 having opposite ends removably attached to the top of vertical tubes 50,52 by U-shaped brackets 106 and suitable fasteners (not shown). A U-shaped cap 108 has a top stiffener 110 which overlies the top of the cross tube 104 as well as front and rear stiffeners 112,114, respectively, which depend downwardly from the top stiffener 110 along the respective front and rear surfaces of the cross tube 104. The U-shaped cap 108 forms a cover for a tensioning assembly 115 comprised of a top plate 116 carrying spaced apart, parallel front and rear plates 118,120 respectively. An idler sprocket 122 is mounted for rotation on a headed clevis pin 124 (FIG. 4) having a shaft 125 which passes through aligned openings in the plates 118 and 120. The end of the pin 124 opposite headed end is provided with a washer 126 and cotter pin 128 to maintain the rotatable position of the sprocket 122. A pair of aligned holes are formed in the top stiffener 110, the cross tube 104 and the top plate 116. A pair of tensioning fasteners 130,132 is passed through the holes, so that the fastener heads 134 with underlying washers 136 are suspended on the top stiffener 110 and lower threaded ends protrude below the top plate 116 where they are provided with nuts 138 screwed thereon. It can thus be appreciated that the vertical position of the idler sprocket 122 can be changed incrementally by screwing the fastener heads 134 one way or the other.

As further illustrated in FIGS. 3 and 9, the lower front structure of the track assembly 14 includes a rectangular motor mounting plate 140 which is fastened at its upper end to cross bar 78 and at its lower end to cross member 38. Secured by bolts 139 and nuts 141 to the lower portion of mounting plate 140 beneath the bottom ends of the joined tube 96 and box channel 98 is a motor mounting bracket 142. The bracket 142 accommodates a drive sprocket 144 mounted on the driven shaft 146 of a gearbox 148 operatively connected to a 24-volt DC electromagnetic motor 150. Such a drive arrangement as compared with the noisy, prior art winch motor is extremely quiet and reliable, less expensive and requires a smaller battery. The gearbox 148 and connected DC motor 150 define a drive unit which is supported on and connected by two screws 152,154 to the front face of a motor mount cover 156 having side portions 158,160 attached in overlying relationship to corresponding side walls 162,164 of bracket 142 by a pair of threaded fasteners 166,168. An angularly-oriented motor shield or guard 170 extends between the crossbar 78 and the rear cross mount 29 to protect the motor 150 therebeneath. A drive chain 172 (FIG. 3) is entrained about idler sprocket 122 at the top of the track assembly 14 with one run 174 extending downwardly completely through the interior of tube 96. Chain 172 has another run 176 extending downwardly partially through the interior of box channel 98 for connection to an upper guide structure 178 of a trolley 180 (FIG. 5) designed to slide upwardly and downwardly along the track assembly 14. The run 176 passing through the tube 96 is wrapped around a sprocket 177 mounted on a shaft 179 at the bottom of the track assembly 14, and runs upwardly through the interior of box channel 98 for connection to a lower guide structure 182 of the trolley 180. It should be appreciated that the drive chain 172 is markedly more reliable than the prior art cable. A drive chain 181 is entrained about sprocket 144 and around a further sprocket 183 connected with sprocket 177 and mounted on shaft 179. Together, the gear box 148, DC motor 150 and drive chains 172,181 provide a direct drive system that delivers the requisite power in moving the trolley 180 and lifting tray assembly 16.

Referring to FIGS. 5 and 6, the upper and lower guide structures 178,182 of the trolley 180 are interconnected by an elongated vertical plate 184 to which the lifting tray assembly 16 is connected. Both the upper and lower guide structures 178,182 project forwardly into the slot 100 formed in the box channel 98. Upper guide structure 178 carries a pair of upper guide wheels 186,188. Upper guide wheels 186,188 are adapted to engage the rear wall 196 of box channel 98 during movement of the trolley 180. Upper guide structure 178 also carries a single upper roller 198 (FIG. 7) on a rod 200 oriented transversely to the shaft 190. Upper roller 198 is adapted to roll along the inside edges 202,204 of the slot 100 formed in the box channel 98. In similar fashion, lower guide structure 182 is provided with a pair of lower guide wheels (only one of which is seen at 206) mounted for rotation on a shaft 210. However, the lower guide wheels 206 are adapted to engage the front wall 211 of box channel 98 during trolley movement. Lower guide structure 182 includes a single lower roller 212 rotatably mounted on a rod 214, and also adapted to roll along the inside edges 202,204 of the slot 100 at a location spaced beneath the upper roller 198. The trolley design of the present invention overcomes the rolling friction and jamming problems experienced with the wheels of prior art lifting tray assemblies.

Lifting tray assembly 16 includes a generally rectangular, corrosion-resistant plastic tray 216 having a support 218 fastened therebeneath such as by fasteners 216 (FIG. 3). As seen in FIGS. 5 and 8, the sides of the tray 220 at their forward ends are provided with a pair of guide blocks 222,224. Each of the guide blocks 222,224 is adjustably secured for fore and aft positioning by a bolt 226 which rides in a horizontal slot 228 formed in the rear portion of each block 222,224 and is secured in position by a nut 230 threaded thereon. The guide blocks 222,224 have respective front surfaces 232,234 which are intended to slide freely with low friction along the rear surfaces of the vertical tubes 50,52 during movement of the lifting tray 216. For this reason, the guide blocks 222,224 are preferably formed of an ultrahigh molecular weight (UHMW) thermoplastic polymer possessing a low coefficient of friction, superior crack resistance and noise dampening properties. Lifting tray assembly 16 also includes a pair of right-angled, tray mounting brackets 236 which depend from the forward end of the tray 216. As seen in FIGS. 3, 5 and 6, each tray mounting bracket 236 has a laterally extending portion 238 and a forwardly extending portion 240. The vertical plate 184 of trolley 180 is interposed between the forwardly extending portions 240 and fixed thereto by bolt 242 which passes through aligned openings in the vertical plate 184 and portions 240. The bolt 242 is secured by nut 244. Attached to the laterally extending portions 238 is a face plate 246 which carries a nut 248 adapted to threadedly receive an adjusting screw 250. A shelf brace 252 is rigidly connected between the rear end of the support 218 and the face plate 246 to support the lifting tray 216. A forward end of the screw 250 is engageable with the rear edge of the trolley vertical plate 184 so that turning of the screw 250 will enable the bottom of lifting tray 216 to be positioned substantially parallel to the ground or floor surface. The structure set forth above enables the lifting tray assembly 16 to move smoothly without binding over the vertical path defined by the track assembly 14. It should be understood that the upper and lower limits of this vertical path can be established by providing upper and/or lower stops along slot 100 formed in the box channel 98.

Figure 11:
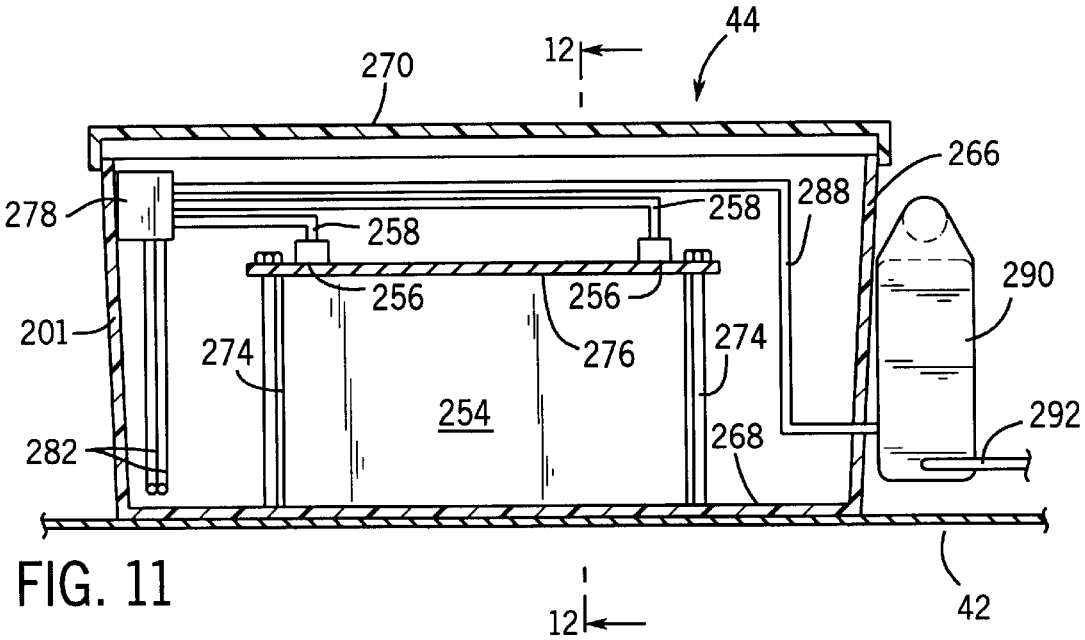
FIG. 11 is a cross sectional view taken on line 11—11 of FIG. 2.
Figure 12:
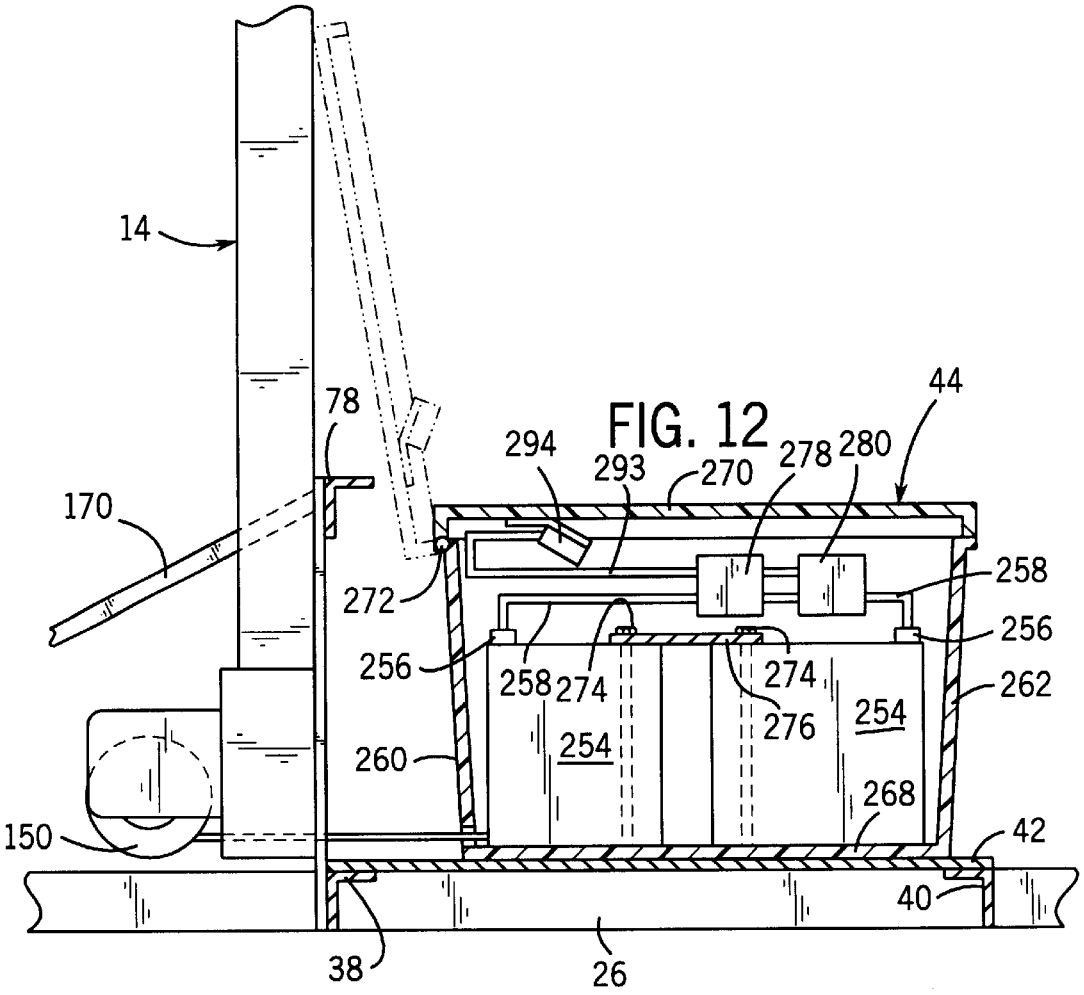
FIG. 12 is a partial cross sectional view taken on line 12—12 of FIG. 11.

Referring to FIGS. 11 and 12, the source of electrical power for the DC motor 150 is a pair of 12-volt DC batteries 254. Wires 258 are connected to battery terminals 256, and are mounted adjacent each other inside the electrical enclosure 44. The enclosure 44 is preferably a NEMA-approved, plastic enclosure having a back wall 260, a front wall 262, side walls 264,266, a bottom wall 268 and a top wall 270 which is hingedly connected at 272 to back wall 260. The batteries 254 are held in place in enclosure 44 by a set of four carriage bolts 274 that pass through openings formed in the corners of a generally rectangular holddown plate 276 and have lower ends threaded into the bottom wall 268. Wires 258 are connected to a pair of relays 278,280 that are secured on the inside surface of side wall 264 as the enclosure 44. One set of wires 282 leading from the relays 278,280 passes through the lower end of side wall 264, and runs to a toggle switch 284. A bracket 286 (FIG. 10) preferably mounts the toggle switch 284 on the top of upper vertical member 72, as seen in FIG. 2. Extending across the upper end of enclosure 44 is a wire 288 that connects the relays 278,280 with a battery charger 290 conveniently mounted on the outside surface of the other side wall 266. The battery charger 290 has an electrical cord 292 which connects to a source of 120 VAC. Also connected to the relays 278,280 is a mercury switch 294 secured to an underside of the hinged top wall 270. As a feature of the invention, the battery charger 290 will not operate when the top wall 270 is pivoted into an open position shown in phantom lines in FIG. 12, at which time the positioning of mercury switch 294 will allow current flow to the battery charger 290. As mentioned, this feature prevents the build-up of gases inside the enclosure 44 might otherwise occur during battery charging. It should be appreciated that once the batteries 254 have been charged, the top wall 270 is closed so that the batteries and the other electrical components are protected from the environment.

Figure 13:
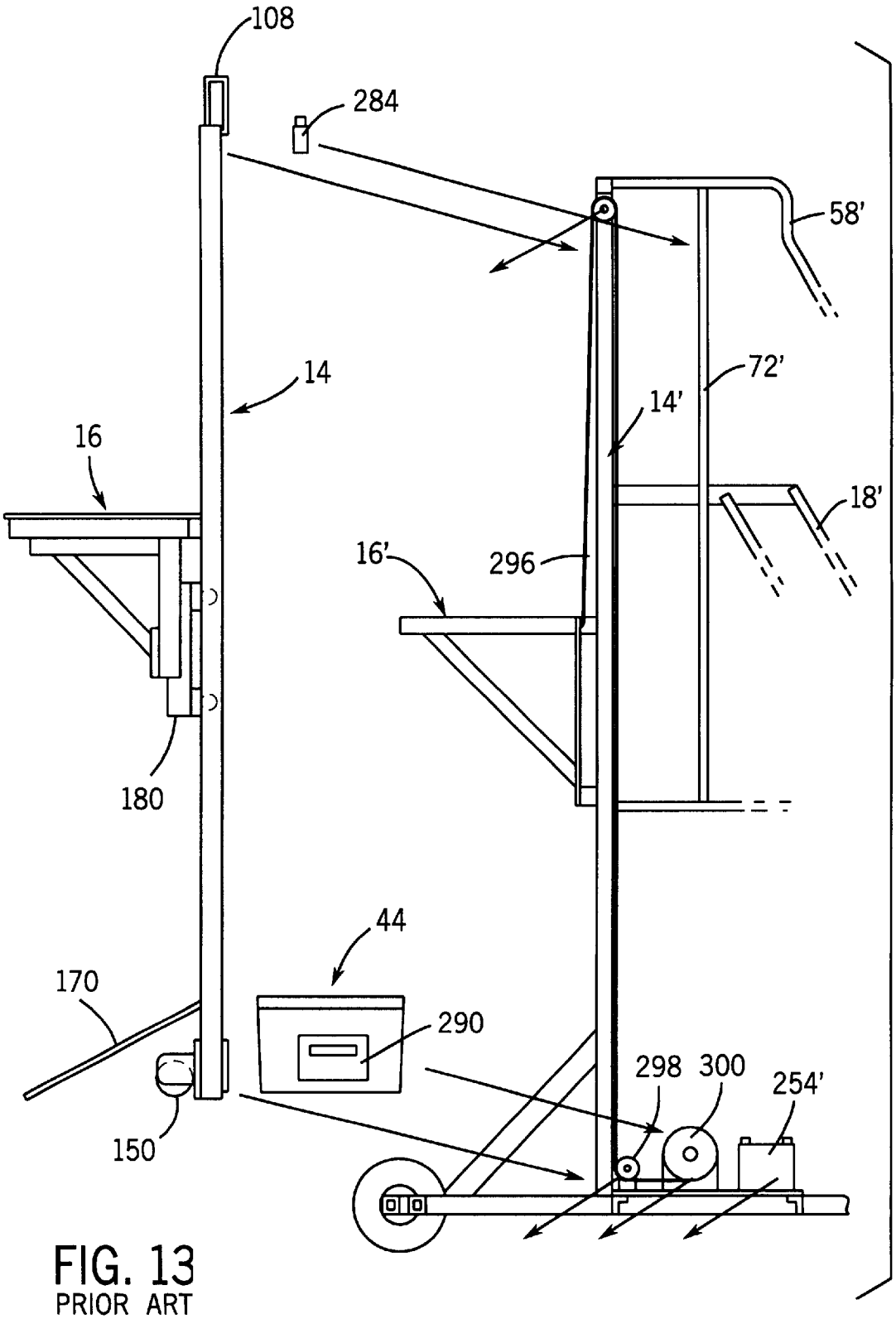
FIG. 13 PRIOR ART
FIG. 13 is a view similar to FIG. 2 showing a prior art ladder being retrofit with portions of the present invention.

Another attractive feature of the invention is the convenient replaceability of the prior art track assembly 14', lifting tray 16', cable system 196, pulley 198, winch motor 300 and uncovered battery 254' by the track assembly 14, trolley 180, lifting tray assembly 16, drive system 144,148,150,172, toggle switch 284 and electrical enclosure 44 of the present invention as represented in FIG. 13 by the various arrows. One interested in retrofitting the prior art stepped structure 12' disconnects the track assembly 14' from the handrails 58' at the top and from the various cross bars spanning the vertical tubes and removes the pulley 298, winch motor 300 and battery 254'. Then, the present track assembly 14 is connected to the top of the handrails 58 using the U-shaped brackets 106 and the various connections to the cross bars 74,76,78 along the length and bottom thereof. The fully equipped electrical enclosure 44 is secured on the mounting plate 42 and the necessary electrical connections are made with the gearbox 148 and motor 150 and the toggle switch 284 which is added to the existing upper vertical member 72. The motor shield 170 can be welded in place between cross bar 78 and the rear cross mount 29 to protect the gearbox and motor unit 148, 150.

It should be pointed out that the invention also contemplates the retrofitting of conventional mobile ladders that do not have a lift. To these mobile ladders, it may be desirable to add the track assembly 14, trolley 180, lifting tray assembly 16, drive system 144, 148, 150, 172, toggle switch 284 and electrical enclosure 44 of the present invention. In these types of retrofit applications, it will probably be necessary to cut a top horizontal support railing from the mobile ladder and replace it with the cross tube 104 and U-shaped brackets 106 (see FIG. 3). In order to facilitate retrofitting, it is preferable that the track assembly 14 include components 104, 106 as well as the other components of the track assembly 14 (including the chain tensioning components) be shipped as a stand alone integral component, or at least easy to assemble.

Figure 14:
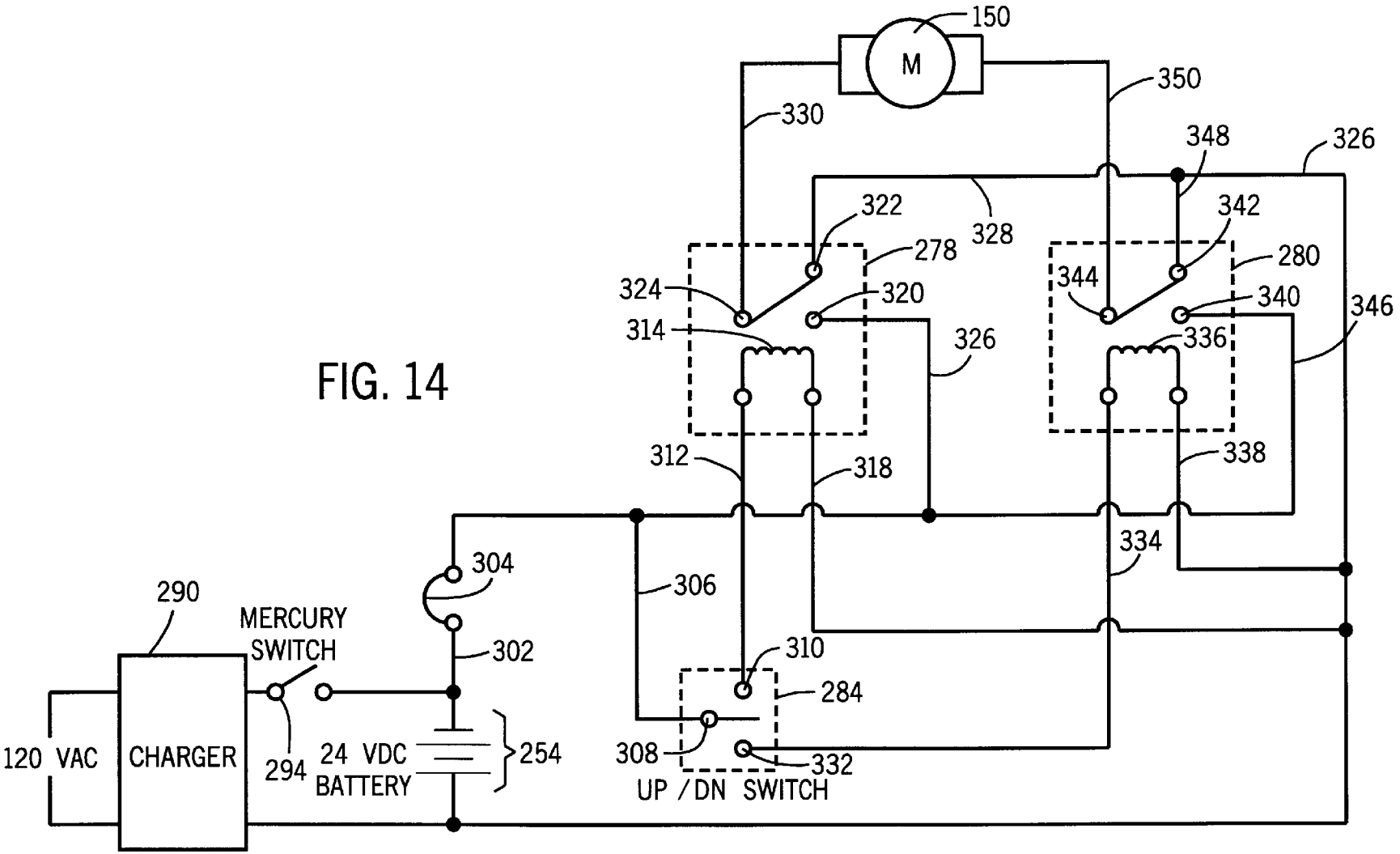
FIG. 14 is a circuit diagram for the present invention.

FIG. 14 shows an electrical schematic of the present invention. The circuit includes a pair of series-connected 12-bolt batteries 254 having one side thereof connected by a wire 302 to a 10-amp fuse 304. Another wire 306 leads to a neutral contact 308 of the toggle or up/down switch 284. One switch contact 310 is connected by wire 312 to one side of a coil 314 of the first or "up" relay 278. The other side of the coil 314 is connected by wire 318 to the other side of the batteries 254. The first relay 278 has a set of normally open contacts 320,322 and a common terminal 324. Contact 320 is connected by wire 326 to one side of the batteries 254 and contact 322 is connected by wire 328 to the other side of the batteries 254. Common terminal 324 is connected by wire 330 to one side of the motor 150. Similarly, the other switch contact 332 is connected by wire 334 to one side of a coil 336 of the second or "down" relay 280. The other side of the coil 336 is connected by wire 338 to the other side of the batteries 254. The second relay 280 has a set of normally open contacts 340,342 and a common terminal 344. Contact 340 is connected by wire 346 to one side of the batteries 254 and contact 342 is connected by wire 348 to the other side of the batteries 254. Common terminal 344 is connected by wire 350 to the other side of motor 150. The circuit also shows that the battery charger 290 connected to a source of 120 volt AC is conditional and will not recharge the batteries 254 until the mercury switch 294 is closed which occurs only when the top wall 270 of enclosure 44 is pulled open, as shown in FIG. 12.

In use, the stepped structure 12 is moved to a location where it is desired to elevate, lower and manipulate various loads, equipment, tools, supplies and materials. Once the user has put his or her foot on the bottommost step 92*a*, the bumpers 66 engage the ground and hold the ladder 18 in place. Instead of ascending the ladder 18 with any of the aforementioned items, the user deposits the items in the lifting tray 216. Assuming the batteries 254 in enclosure 44 are adequately charged, the user climbs to the top step or platform 92*h* grasping the handrails 58 during ascent. Once the user has reached the platform 92*h*, the toggle switch 284 on the upper vertical member 72 (FIG. 2) becomes accessible to one of the user's hands. The loaded lifting tray 216 is then ready to be raised from a lower position shown in phantom position A, in FIG. 2, to an upper position shown in phantom position B. When the user moves the toggle switch 284 from the neutral position to an "up" position, electrical power flows from the batteries 254 to one side of the "up" coil 314 pulling in the contact 322 so that the motor 150 is energized to drive in a direction that causes the drive sprocket 144 and chain 172 to elevate the loaded lifting tray 216 and trolley 180 along the track assembly 114. When the lifting tray 216 has reached the desired elevation, the switch 284 is brought to the neutral position in which no electrical power feeds the motor 150. When it is desired to lower the lifting tray 216, the user places the switch 284 in the "down" position. Now, electrical power flows from the batteries 254 to one side of the "down" coil 342 pulling in contact 336. The motor 150 is energized to drive in reverse direction which causes the drive sprocket 44 and chain 172 to pull down the lifting tray 216 along the track assembly 14.

During operation of the present invention, the horizontal plane of the lifting tray 216 relative to the ground may be easily adjusted by means of the adjusting screw 250. In addition, the tensioning assembly 115 may be used to effect adjustment or replacement of the chain 172 as is necessary.

Various alternatives and embodiments are contemplated as being within the scope of the following claims particularly pointing out and distinctly claiming the subject matter regarded as the invention.

We claim:

1. A combined stepped structure and lifting mechanism comprising:

a base;

a framework secured to the base, the framework having a pair of spaced apart vertical tubes rising upwardly from the base;

a ladder incorporated in the framework;

a vertical track assembly disposed between the vertical tubes and including a pair of tubular members connected together;

a trolley rollably mounted for movement along one of the tubular members;

a lifting tray assembly connected for movement with the trolley; and a drive system operably connected to the trolley and driven by a DC motor and gearbox unit mounted and juxtaposed to a bottom end of the vertical track assembly to selectively move the lifting tray assembly upwardly and downwardly along the vertical track assembly.

2. The combined stepped structure and lifting mechanism of claim 1, wherein the tubular members of the vertical track assembly include a square tube and a box channel having a front wall and a rear wall provided with spaced apart surfaces forming a slot running along the length of the rear wall.

3. The combined stepped structure and lifting mechanism of claim 2, wherein the trolley has an elongated vertical plate provided with an upper guide structure projecting through the slot and including an upper guide wheel engageable with the box channel rear wall, and lower guide structure projecting through the slot and including a lower guide wheel engageable with the box channel front wall.

4. The combined stepped structure and lifting mechanism of claim 3, wherein the upper guide structure further includes an upper guide roller engageable with the surfaces forming the slot, and the lower guide structure further includes a lower guide roller engageable with the surfaces forming the slot.

5. The combined stepped structure and lifting mechanism of claim 4, wherein the upper and lower guide rollers are mounted on axes of rotation which are substantially perpendicular to axes of rotation of the upper and lower guide wheels.

6. The combined stepped structure and lifting mechanism of claim 3, wherein the top of the vertical track assembly includes an idler sprocket mounted for rotation and the bottom of the vertical track assembly includes a drive sprocket mounted for rotation upon a driven shaft extending from the DC motor and gearbox unit.

7. The combined stepped structure and lifting mechanism of claim 6, wherein the drive system includes a first run of drive chain entrained about the idler sprocket running entirely through the square tube and wrapping around the drive sprocket, and a second run of drive chain running partially through the box channel and being connected to the upper guide structure and the lower guide structure.

8. The combined stepped structure and lifting mechanism of claim 3, wherein the lifting tray assembly includes a generally rectangular tray having sides provided at forward ends with guide blocks constructed of low friction material slidably engageable with the framework vertical tubes.

9. The combined stepped structure and lifting mechanism of claim 8, wherein the lifting tray assembly further includes a pair of spaced apart, right-angled, tray mounting brackets depending from the forward end of the tray, each tray mounting bracket having a laterally extending portion and a forwardly extending portion.

10. The combined stepped structure and lifting mechanism of claim 9, wherein the vertical plate of the trolley is interposed between the forwardly extending portions of the tray mounting brackets and fixed thereto.

11. The combined stepped structure and lifting mechanism of claim 9, wherein the lifting tray assembly also includes a face plate attached to the laterally extending portion of the tray mounting brackets and provided with a nut adapted to receive an adjusting screw which passes through the face plate and between the tray mounting brackets.

12. The combined stepped structure and lifting mechanism of claim 11, wherein an end of the adjusting screw is engageable with the vertical plate to adjust the level of the tray.

13. The combined stepped structure and lifting mechanism of claim 1, wherein the drive system includes a chain enclosed by the vertical track assembly and connected with the trolley, the chain being driven by the DC motor and gearbox unit.

14. The combined stepped structure and lifting mechanism of claim 13, including an adjustment assembly mounted on the vertical track assembly for tensioning the chain.

15. In a combined stepped structure and lifting mechanism having a movable base, a framework rising from the base, a ladder incorporated in the framework, a vertical track assembly secured to the framework, a lifting tray assembly mounted for movement along the vertical track assembly and a drive system mounted adjacent the base for selectively moving the lifting tray assembly along the vertical track assembly, the improvement wherein:

the vertical track assembly is formed by a tubular structure extending between top and bottom portions of the framework; and the drive system is also mounted adjacent the bottom end of the vertical track assembly and includes a drive chain passing through the interior of the tubular structure which is entrained about an idler sprocket rotatably mounted at the top of the vertical track assembly and a drive sprocket which is driven by an electromagnetic DC motor and gearbox unit secured to a bottom end of the framework.

16. The improvement of claim 15, wherein the tubular structure is defined by a pair of elongated tubular members connected together in side-by-side relationship.

17. The improvement of claim 15, wherein the vertical track assembly includes a mechanism for adjusting the tension of the drive chain.

18. The improvement of claim 15, wherein a protective guard is connected between the base and the framework over the DC motor and gearbox unit.

19. In a combined stepped structure and lifting mechanism having a movable base, a framework rising from the base, a ladder incorporated in the framework, a vertical track assembly secured to the framework, a lifting tray assembly mounted for movement along the vertical track assembly, and a drive system including a DC motor mounted adjacent the base for selectively moving the lifting tray assembly along the vertical track assembly, the improvement wherein:

the drive system is also mounted adjacent the bottom end of the vertical track assembly; and a protective enclosure mounted on the base and having a battery connected to the DC motor for energization thereof, the enclosure having a lower structure and a top structure hingedly attached thereto, the lower structure carrying a battery recharger adapted to be connected to a source of AC power and the top structure being provided with a mercury switch on an inside surface thereof, whereby the battery recharger is operational only when the top structure is pivoted away from the lower structure to prevent the buildup of gases within the enclosure.

20. The improvement of claim 19, wherein the enclosure is disposed between the ladder and the vertical track assembly.

21. The improvement of claim 19, wherein the lower structure of the enclosure includes a pair of relays for controlling power to the DC motor.

22. The improvement of claim 19, wherein the DC motor is selectively controlled by a toggle switch operably connected to the battery means and mounted on an upper portion of the framework.

23. For use in retrofitting a mobile ladder having a movable base and a framework rising from the base with a ladder incorporated in the framework, a vertical track and lifting tray assembly comprising:

a vertical track assembly having a pair of elongated tubular members connected together in side by side relationship, a trollery rollably mounted for movement along one of the tubular members, a generally planar lifting tray connected for movement on the trolley and a self contained direct drive system including a drive chain, which is connected to the trolley, passes through the interior of the tubular members and is entrained about an idler sprocket mounted for rotation at a top end of the vertical track assembly, and a drive sprocket rotatably mounted on a drive shaft;

a DC motor and gearbox unit secured and juxtaposed to a bottom end of the vertical track assembly and providing mechanical power to drive the drive shaft; and a top horizontal cross tube mounted to a top of the vertical track assembly, said cross tube being adapted to connect to the ladder framework.

* * * * *

UNITED STATES PATENT AND TRADEMARK OFFICE

CERTIFICATE OF CORRECTION

PATENT NO. : 6,283,249 B1
DATED : September 4, 2001
INVENTOR(S) : David T. Young and Scott E. Kaczor It is certified that error appears in the above-identified patent and that said Letters Patent is hereby corrected as shown below:

Column 12,
Line 40, delete "means";
Line 48, delete "trollery" and substitute therefor-- trolley --

Signed and Sealed this

Thirtieth Day of April, 2002

*Attest:*

*Attesting Officer*

JAMES E. ROGAN
*Director of the United States Patent and Trademark Office*